US008128538B2

(12) United States Patent
Lines

(10) Patent No.: US 8,128,538 B2
(45) **Date of Patent: *Mar. 6, 2012**

(54) EXERCISE ASSEMBLIES HAVING FOOT-RETAINING APPARATUS

(75) Inventor: L. Kent Lines, Carnation, WA (US)

(73) Assignee: Vectra Fitness, Inc., Redmond, WA (US)

( * ) Notice: Subject to any disclaimer, the term of this patent is extended or adjusted under 35 U.S.C. 154(b) by 348 days.

This patent is subject to a terminal disclaimer.

(21) Appl. No.: 11/467,108

(22) Filed: Aug. 24, 2006

(65) Prior Publication Data

US 2008/0051269 A1 Feb. 28, 2008

(51) Int. Cl.
*A63B 21/062* (2006.01)

(52) U.S. Cl. ..... 482/100

(58) Field of Classification Search ..... 482/92–102, 482/142, 139, 148

See application file for complete search history.

(56) References Cited

U.S. PATENT DOCUMENTS

| | | | | |
|---|---|---|---|---|
| 2,942,698 | A | 6/1960 | Bolinger | |
| 3,102,298 | A | 9/1963 | Sheahan | |
| 4,821,369 | A | 4/1989 | Daniels | |
| 5,421,636 | A | 6/1995 | Gamble | |
| 5,799,366 | A | 9/1998 | Zocco et al. | |
| 5,916,072 | A | 6/1999 | Webber | |
| 5,967,955 | A | 10/1999 | Westfall et al. | |
| 6,090,020 | A | 7/2000 | Webber | |
| 6,719,673 | B1 * | 4/2004 | LaPlaca | 482/99 |
| 6,905,446 | B2 | 6/2005 | Greenland | |
| 7,094,185 | B2 | 8/2006 | Greenland | |
| 7,096,533 | B2 | 8/2006 | Griepentrog | |
| 7,101,327 | B1 | 9/2006 | Baumler et al. | |
| 2002/0013200 | A1 | 1/2002 | Sechrest et al. | |
| 2003/0027697 | A1 | 2/2003 | Baumler | |
| 2003/0100413 | A1 | 5/2003 | Huang | |
| 2004/0214697 | A1 * | 10/2004 | Gerschefske et al. | 482/142 |
| 2005/0159278 | A1 * | 7/2005 | McVay et al. | 482/142 |
| 2006/0247097 | A1 * | 11/2006 | La Voie et al. | 482/8 |
| 2007/0111866 | A1 * | 5/2007 | McVay et al. | 482/95 |
| 2007/0135272 | A1 * | 6/2007 | Stuckey | 482/98 |
| 2008/0214367 | A1 * | 9/2008 | Webber et al. | 482/95 |

OTHER PUBLICATIONS

Cybex, "The Cybex Ft 360 Functional Trainer", retrieved on Sep. 8, 2005 at http://www.ecybex.com/products/Strength/FT360Index.aspx, 2 pages.

Freemotion Fitness, "FreeMotion Dual Cable Cross", retrieved on Sep. 8, 2005 at http://www.iconfitness.com/cgi-bin/ncommerce3/ExecMacro/product/freeMotion/v3/produc....., two pages.

Image, retrieved on Sep. 8, 2005 at http://www.tuffstuff.net/retail/images/home_equip/home_gyms/acs100/ACSMain.jpg, 1 page.

(Continued)

*Primary Examiner* — Lori Baker

(57) ABSTRACT

Exercise assemblies having apparatus that retain the feet of a user during an exercise are disclosed. In one embodiment, an exercise assembly includes a load, and a support assembly operatively positioned relative to the load and including a base assembly. A force-transferring assembly is operatively coupled between the load and an exercise station such that a training force applied to the exercise station induces an associated force on the load. A foot-retaining assembly is operatively coupled to the support assembly and includes at least one foot-retaining device defining a foot-retaining space configured to receive at least a portion of a foot of the user. The foot-retaining device prevents a vertical movement of the foot of the user during the exercise.

17 Claims, 15 Drawing Sheets

OTHER PUBLICATIONS

Life Fitness, "New Life Fitness G5 Gym System", retrieved on Sep. 8, 2005 at http://us.home.lifefitness.com/content.cfm/g5, pp. 1-4, plus additional page.
Paramount, "Functional Training System Model FT-150", retrieved on Sep. 8, 2005 at http://www.paramountfitness.com/pages/ft/150.html, 1 page.
Paramount, "Paramount Functional Trainer Model PFT-200", retrieved on Sep. 8, 2005 at http://www.paramountfitness.com/pages/ft/200.html, 1 page.
SNEWS, "HFBiz Show '05: Strength Equipment Has, Yes, Strong Showing", Posted Sep. 6, 2005 in Category(s): Fitness, from http://www.snewsnet.com, pp. 1-7.
Vortex, "Functional & Core Strength Training Systems Featuring the Vortex "Grab & Train"", retrieved on Sep. 8, 2005 at http://www.vortexfitness.com/exercise_equipment_products/Pro_Trainer.html, pp. 1-4.

* cited by examiner

EXERCISE ASSEMBLIES HAVING FOOT-RETAINING APPARATUS

CROSS-REFERENCE TO RELATED APPLICATIONS

This patent application is related to co-pending, commonly-owned U.S. patent application Ser. No.11/467,079 entitled "Functional Training Exercise Apparatus and Methods" filed concurrently herewith on Aug. 24, 2006 under; U.S. patent application Ser. No.11/467,094 entitled "Exercise Assemblies Having Self-Adjusting Pad Devices" filed concurrently herewith on Aug. 24, 2006 under; U.S. patent application Ser. No.11/467,066 entitled"Exercise Bench Assemblies Having Wheels With Integral Brakes" filed concurrently herewith on Aug. 24,2006, which applications are hereby incorporated by reference.

FIELD OF THE INVENTION

This invention relates generally to exercise assemblies having apparatus that retain the feet of a user during the performance of an exercise.

BACKGROUND OF THE INVENTION

The advantages of weight-training exercise machines are widely recognized. Conventional weight-training exercise machines may feature single or multiple stations which enable a user to perform one or a variety of exercises for developing and toning different muscle groups. For example, the various stations of such exercise machines may include one or more stations that enable a user to exercise muscles of the arms and upper body using "press," "shrug," or "curl" types of movements, and one or more stations for exercising muscles of the legs using "squat," "press," or "extension" types of movements. Such weight machines provide the desired muscle training capability in a convenient, safe, and efficient manner.

Although prior art exercise apparatus and methods have achieved desirable results, there is room for improvement. For example, during the performance of some exercises (e.g. "pull down" exercises), when sufficient weight is selected, the training force applied by the user may undesirably cause the user's body to rise from a seat, bench, or other support surface. Such movement may undesirable detract from the effectiveness of the exercise, and may reduce the user's satisfaction with the exercise experience. Novel methods and apparatus that mitigate these negative characteristics would therefore have utility.

SUMMARY OF THE INVENTION

The present invention is directed to exercise machines having foot-retaining apparatus. Embodiments of the invention may advantageously provide improved control to a user during the performance of an exercise, particularly those exercises that tend to lift a user upwardly during the performance of the exercise.

In one embodiment, an exercise assembly that enables a user to perform an exercise includes a load, and a support assembly operatively positioned relative to the load and including a base assembly configured to engage a support surface, and at least one exercise station. A force-transferring assembly is operatively coupled between the load and the at least one exercise station, the force-transferring assembly being configured such that a training force applied to the at least one exercise station induces an associated force on the load. A foot-retaining assembly is operatively coupled to the support assembly and includes at least one foot-retaining device defining a foot-retaining space configured to receive at least a portion of a foot of the user. The at least one foot-retaining device is configured to prevent a vertical movement of the foot of the user during the performance of the exercise.

BRIEF DESCRIPTION OF THE DRAWINGS

Embodiments of the present invention are described in detail below with reference to the following drawings.

DETAILED DESCRIPTION

Many specific details of certain embodiments of the invention are set forth in the following description and in FIGS. 1-27 to provide a thorough understanding of such embodiments. One skilled in the art, however, will understand that the present invention may have additional embodiments, or that the present invention may be practiced without several of the details described in the following description.

Functional Training Exercise Apparatus and Methods

In general, embodiments of apparatus and methods in accordance with the present invention enable a user to perform exercises using functional training movements. As used in this disclosure, the term functional training movements refers to movements for training the body the way it will be used in activities of daily living, including movements associated with sports, or movements associated with a user's work, hobby, or therapeutic activities. Examples of functional training movements include, but are not limited to, torso bending and twisting movements, pushing and pulling movements, and sporting movements such as swinging a sporting apparatus (e.g. a bat, racquet, stick, golf club, etc.), throwing or tossing a sporting device (e.g. a baseball, shot put, discus, football, etc.), or any other desired functional training movements.

Figure 1:
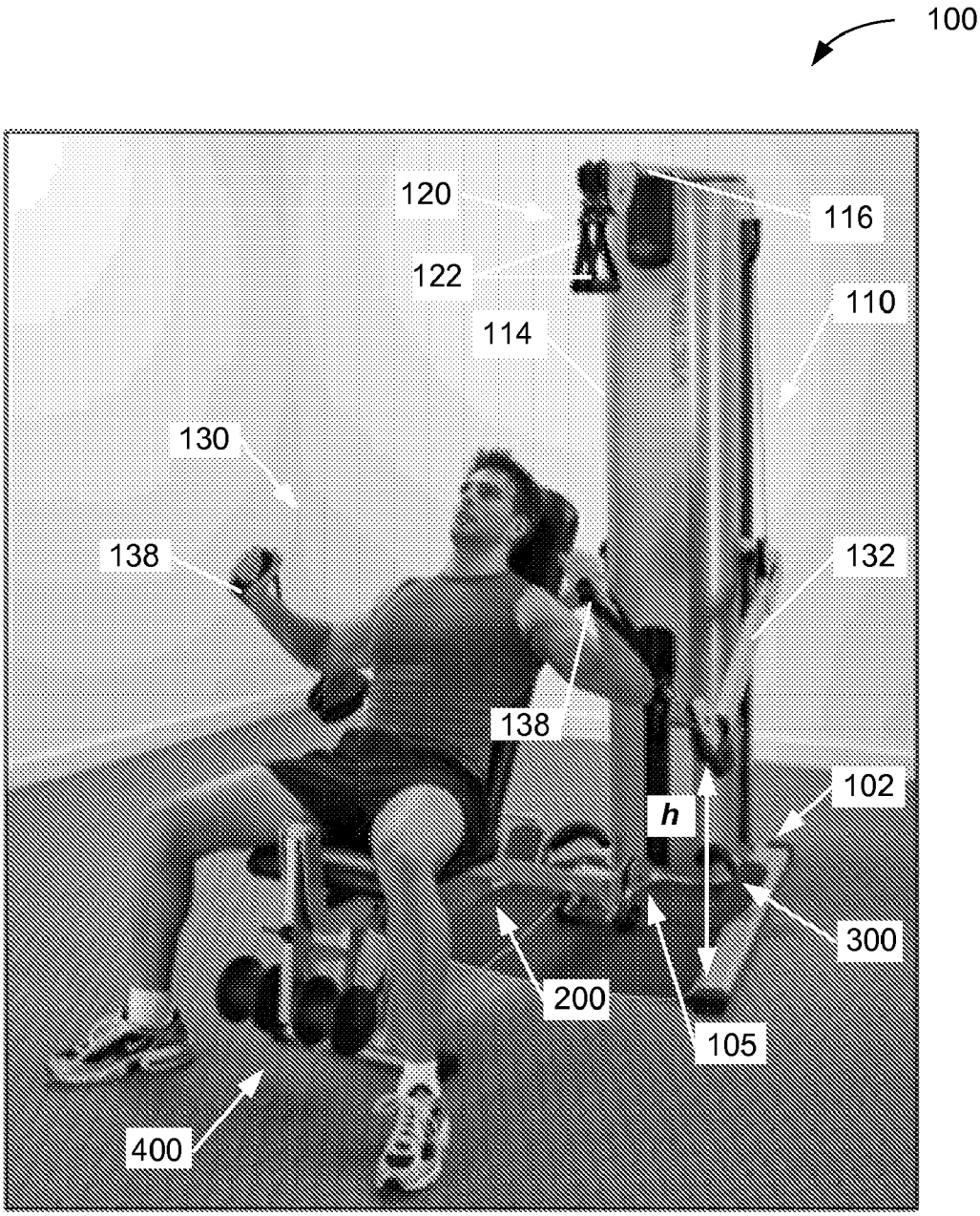
FIG. 1 is an isometric view of a functional training exercise assembly in accordance with an embodiment of the invention.
Figure 2:
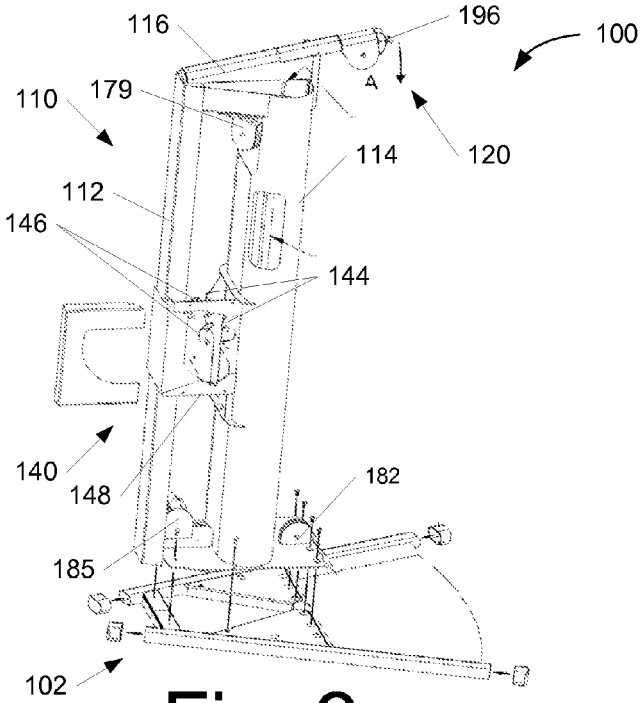
FIG. 2 is a partially-exploded isometric view of the functional training exercise assembly of FIG. 1.

FIG. 1 is an isometric view of a functional training exercise assembly 100 in accordance with an embodiment of the invention. FIG. 2 is a partially-exploded side view of the functional training exercise assembly 100 of FIG. 1. In this embodiment, the functional training exercise assembly 100 includes an upwardly extending central portion 110 coupled to a base assembly 102 that rests on a support surface (e.g. a floor). The central portion 110 includes an upright support member 112 and a shield member 114 proximate to the upright support member 112. A lateral support member 116 extends from the upright support member 112 to a first exercise station 120. As shown in FIG. 1, the first exercise station 120 may include a pair of first handles 122.

Figure 10:
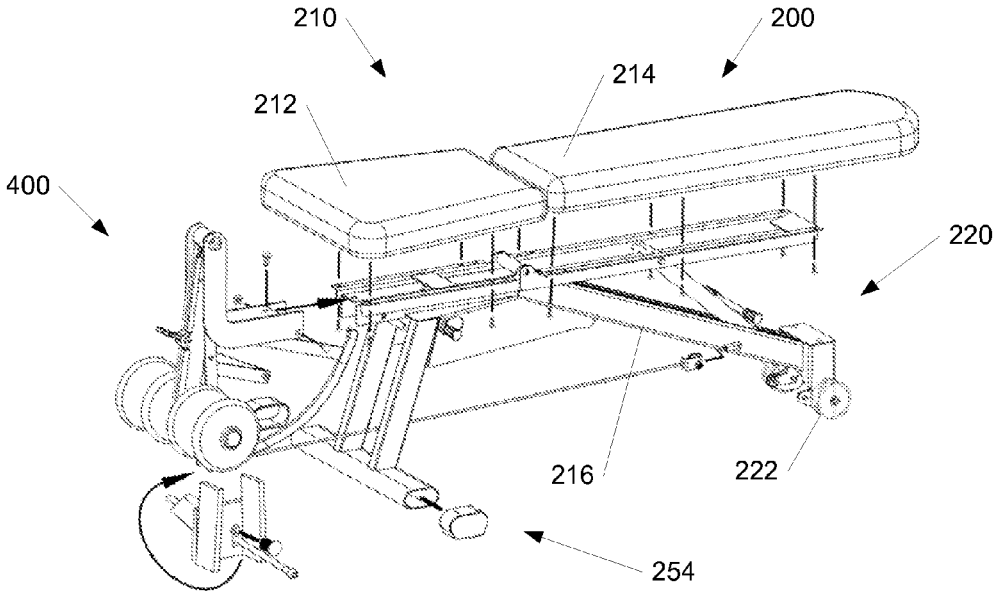
FIG. 10 is a partially-exploded isometric view of a bench assembly in accordance with another embodiment of the invention.

A second exercise station 130 is coupled to the upright support member 112 and the shield member 114 by an adjustable coupling assembly 140 (shown in FIG. 2). A bench assembly 200 (FIG. 1) may be positioned proximate the shield member 114 to support a user during use of the first and second exercise stations 120, 130. One suitable embodiment of the bench assembly 200 is shown in FIG. 10.

Figure 3:
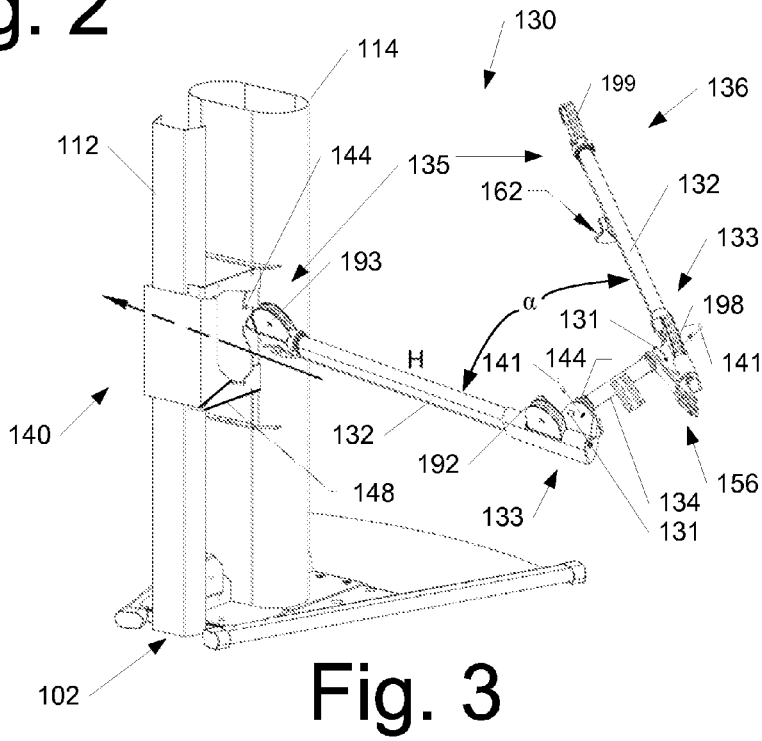
FIG. 3 is a partially disassembled isometric view of the functional training exercise assembly of FIG. 1.

As best shown in FIG. 3, the second exercise station 130 includes a pair of frame members 132, each frame member 132 having a proximal end portion 133 coupled to a cross member 134. A pair of second handles 138 (FIG. 1) are located at distal end portions 135 of the frame members 132. In FIG. 3, the cross member 134 is shown in a partially-disassembled position 136 relative to the adjustable coupling assembly 140. The cross member 134 engages with the adjustable coupling assembly 140 to enable the frame members 132 of the second exercise station 130 to be adjustably positioned by a user to a desired height h (FIG. 1) relative to the base assembly 102, as described more fully below.

In some embodiments, the frame members 132 are separate components that are coupled together by the cross member 134, and in other embodiments, the frame members 132 and the cross member 134 are different portions of a single, unitary member. In further embodiments, the assembly including the frame members 132 and the cross member 134 may be formed from two pieces (e.g. two "L"-shaped members), or any other suitable number of pieces. In general, each frame member 132 projects outwardly from the cross member at an angle having a corresponding vertex such that the assembly including the frame members 132 and the cross member 132 generally forms an angled member having a pair of angles and a pair of vertices.

More specifically, in some embodiments, the frame members 132 are rigidly coupled to the cross member 134 at a fixed angle a. Alternately, the proximal end portions 133 may be pivotably (or hingeably) coupled to the cross member 134 by pivotable coupling assemblies 131 to enable the angle a to be adjusted as desired by the user. After adjustment to a desired value, the angle a may remain fixed during the exercise, such as by providing the user with a locking pin 141 selectively engageable through one or more suitable portions of the pivotable coupling assembly 131 (and the frame and cross members 132, 134) to lock the frame member 132 in a fixed position relative to the cross member 134. Alternately, the locking pin 141 may be disengaged to enable the angle a to vary freely during an exercise.

Furthermore, for some functional training exercises, it may be desirable for the user to allow the angle a to vary freely during the exercise to enable the user to perform the desired functional training movements using one or both of the second handles 138 of the second exercise station 130. In some embodiments, as shown in FIG. 3, the pivotable coupling assemblies 131 may allow the frame members 132 to move independently of one another to vary the angle a by moving only one of the frame members 132. In alternate embodiments, however, the pivotable coupling assemblies 131 may constrain the frame members 132 to move together (dependently). Thus, the functional training exercise assembly 100 allows the user to perform functional training movements that more closely approximate movements associated with daily life, including, for example, a particular sporting event or a particular movement associated with a user's hobby, work, or therapeutic activities.

Figure 4:
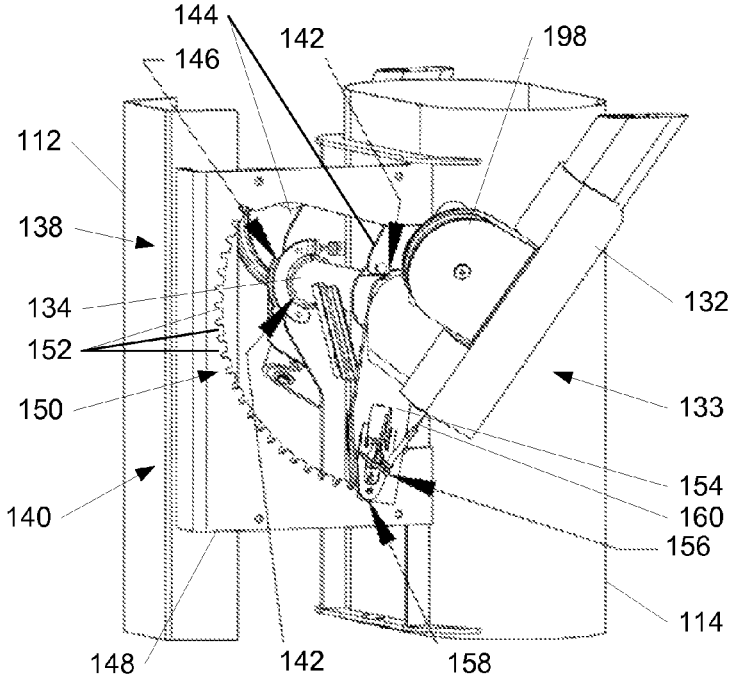
FIGS. 4 and 5 are enlarged, isometric views of an adjustable coupling assembly in an assembled position with a cross member of FIG. 3.
Figure 5:
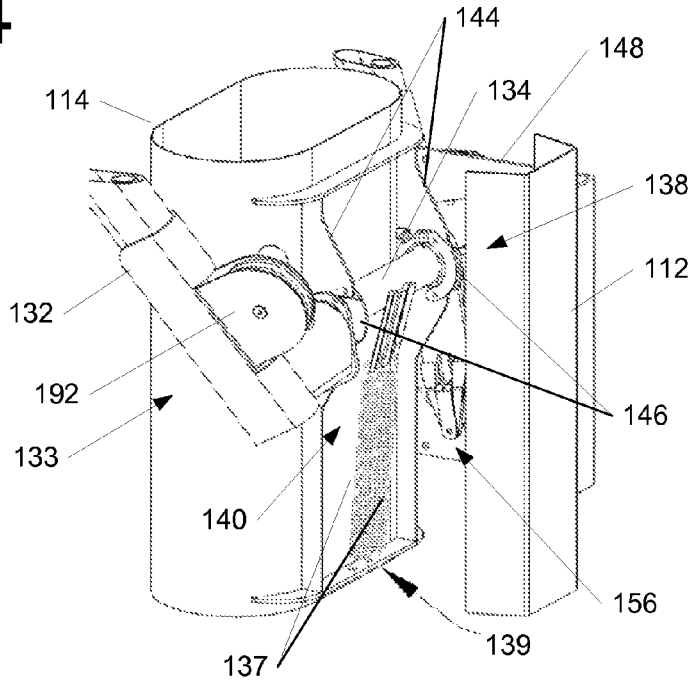

FIGS. 4 and 5 are enlarged, isometric views of the adjustable coupling assembly 140 with the cross member 134 in an assembled position 138. In this embodiment, a pair of bushings 142 are positioned on the cross member 134 and are fittingly engaged into a corresponding pair of brackets 144 on the shield member 114. Bushing retainers 146 are secured to the brackets 144 to retain the bushings 144 into position within the brackets 144. A pair of biasing devices (or springs) 137 are coupled between the cross member 134 and a cross bracket 139 (FIG. 5) on the shield member 114.

As best shown in FIG. 4, a plate 148 extends between the upright support member 112 and the shield member 114. The plate 148 includes an indexing portion 150 having a plurality of indexing members 152 (e.g. teeth or slots). A locking arm 154 is coupled to the cross member 134 and extends toward the indexing portion 150 of the plate 148. A locking assembly 156 is coupled to the locking arm 154 and includes a retractable portion 158 that selectively engages with one or more of the indexing members 152. A coupling member (e.g cable) 160 couples the retractable portion 158 to a release lever 164 positioned on one of the frame members 132 (FIG. 3). The structure and operation of the release lever 164 and locking assembly 156 may be of any suitable type, including those devices described, for example, in U.S. Pat. No. 6,508,748 issued to Ish.

In operation, a user may adjust the positions of the frame members 132 of the second exercise station 130 to any desired height h relative to the base assembly 102. More specifically, the user may actuate the release lever 162 to cause the retractable portion 158 of the locking assembly 156 to disengage from the indexing portion 150 of the plate 148, enabling the frame members 132 to be raised and lowered to the desired height h. The user may then perform functional training exercises using the second exercise station 130, as described more fully below.

Figure 6:
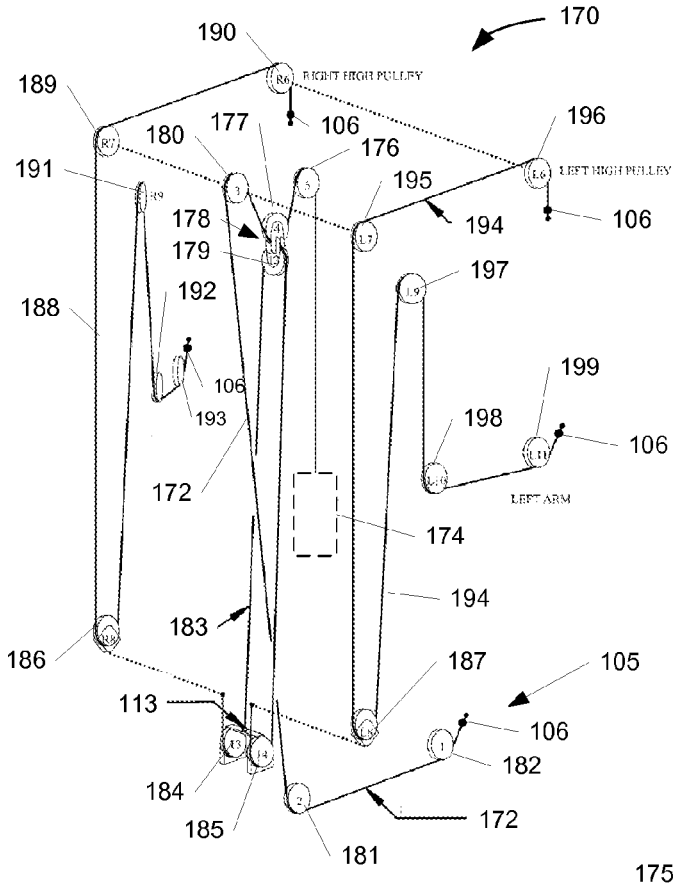
FIG. 6 is a cable and pulley assembly of the functional training exercise assembly of FIG. 1.
Figure 7:
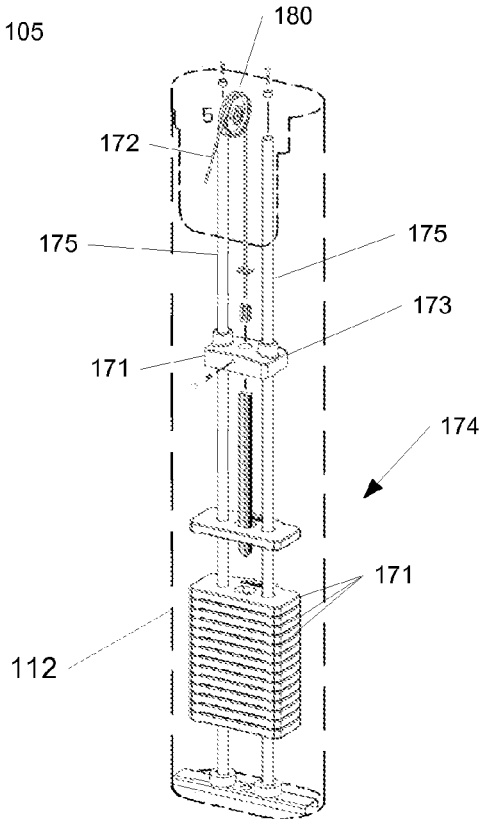
FIG. 7 is an enlarged, partially hidden view of a central portion of the functional training exercise assembly of FIG. 1.

FIG. 6 is a cable and pulley assembly 170 of the functional training exercise assembly 100 of FIG. 1. In this embodiment, the cable and pulley assembly 170 includes a first cable 172 having a first end that is coupled to a load 174 disposed within a lower portion of the shield member 114. As best shown in FIG. 7, in this case, the load 174 consists of one or more plates 171 of a weight stack. The plates 171 are selectively coupled to an engagement member 173 attached to the first cable 172 (shown in a partially disassembled view in FIG. 7), and are slideable along a pair of guide members 175 in a conventional manner.

As further shown in FIG. 6, the first cable 172 operatively engages a first fixed pulley 176 positioned above the weight stack 174. The first cable 172 then engages an upper pulley 177 of a first double-floating pulley 178, a second fixed pulley 180 positioned above the first double-floating pulley 178, third and fourth fixed pulleys 181, 182 positioned below the second fixed pulley 180 (e.g. proximate the base assembly 102), and terminates at a third exercise station 105 such as, for example, a low-pull station.

Figure 9:
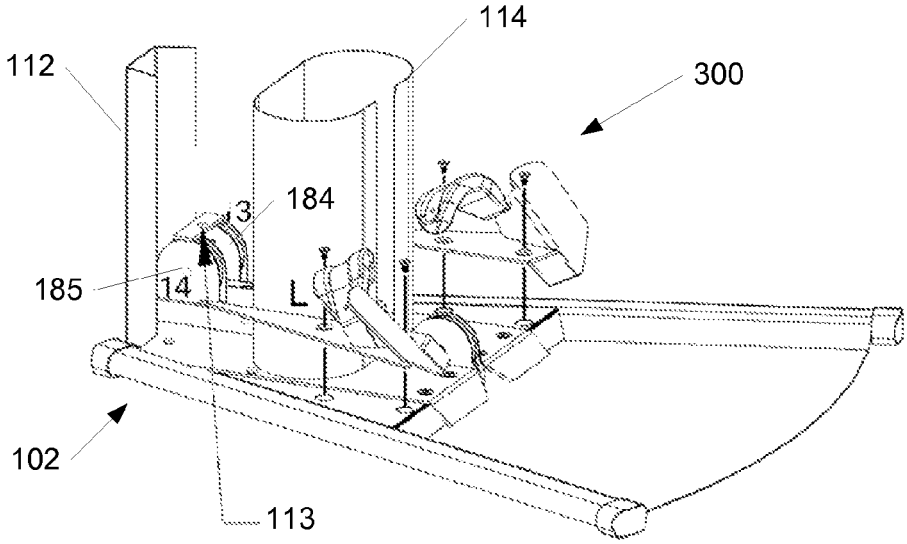
FIG. 9 is an enlarged, partially hidden view of a lower portion of the functional training exercise assembly of FIG. 1.

A second cable 183 engages a lower pulley 179 of the first double-floating pulley 178 and extends downwardly to engage with fifth and sixth fixed pulleys 184, 185. One possible structural arrangement of the cable and pulley assembly 170 and the lower portion of the exercise assembly 100 is shown in FIG. 9. In the embodiment shown in FIGS. 6 and 9, the fifth and sixth fixed pulleys 184, 185 are positioned proximate the base assembly 102 and near the upright support member 112. A tension adjustment member 113 engages the fifth and sixth fixed pulleys 184, 185 and enables the fifth and sixth fixed pulleys 184, 185 to be adjusted vertically in order to controllably adjust the tension and in the second cable 183. The ends of the second cable 183 are coupled to first and second single floating pulleys 186, 187 (FIG. 6).

Figure 8:
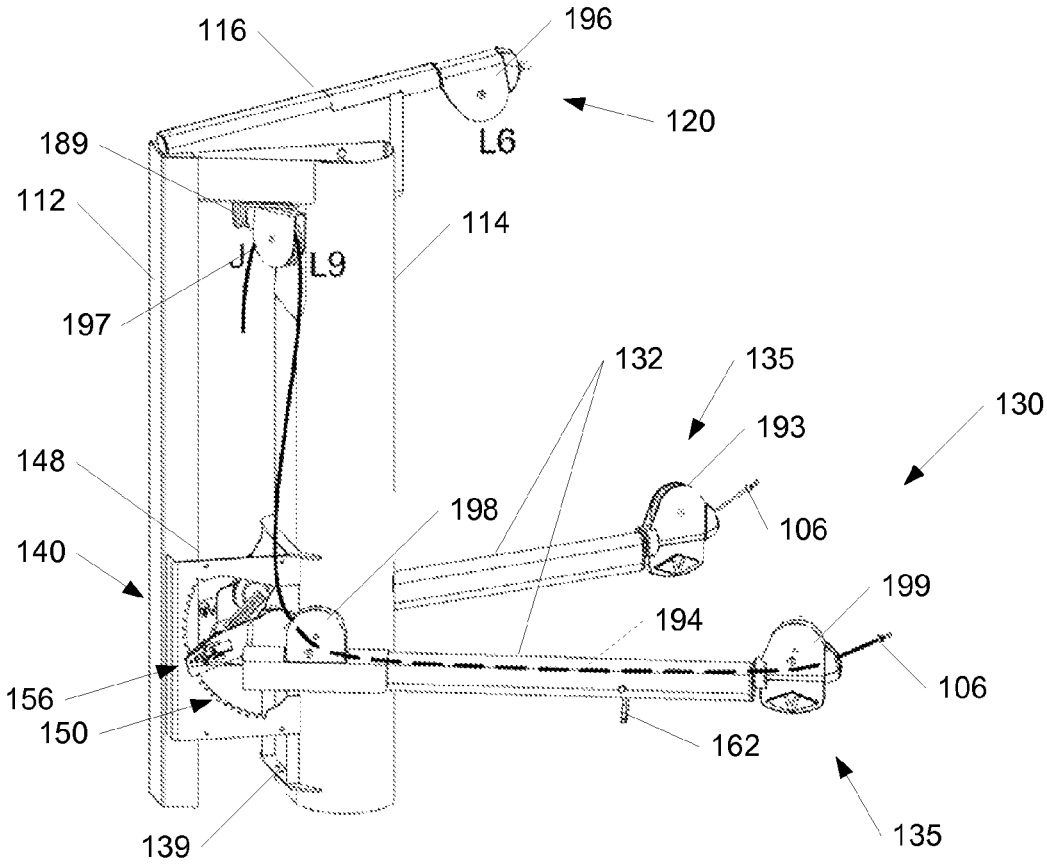
FIG. 8 is an enlarged, partially hidden view of an upper portion of the functional training exercise assembly of FIG. 1.

With continued reference to FIG. 6, the cable and pulley assembly 170 further includes a third cable 188 that operatively engages the first single floating pulley 186. From the first single floating pulley 186, the third cable 188 extends upwardly to a seventh fixed pulley 189 positioned proximate an upper portion of the upright support member 112, and to an eighth fixed pulley 190 coupled to the lateral support member 116. A first end of the third cable 188 terminates at the first exercise station 120, and may be coupled to one of the first handles 122 (FIG. 1). The third cable 188 also extends from the first single floating pulley 186 upwardly to a ninth fixed pulley 191, and then to tenth and eleventh fixed pulleys 192, 193 coupled to proximal and distal portions 133, 135, respectively, of one of the frame members 132 (see FIG. 2). One possible embodiment of a structural relationship between the cable and pulley assembly 170 and the frame members 132 of the second exercise station 130 is shown in FIG. 8.

Similarly, a fourth cable 194 engages the second single floating pulley 187 and extends upwardly to a twelfth fixed pulley 195 positioned proximate an upper portion of the upright support member 112, and to a thirteenth fixed pulley 196 coupled to the lateral support member 116. A first end of the fourth cable 188 terminates at the first exercise station 120, and may be coupled to one of the first handles 122 (FIG. 1). As further shown in FIG. 6, the fourth cable 194 also extends from the second single floating pulley 187 to a fourteenth fixed pulley 197, and then engages with fifteenth and sixteenth fixed pulleys 198, 199 coupled to proximal and distal portions 133, 135, respectively, of the other of the frame members 132 (see FIG. 2). The second handles 138 of the second exercise station 130 (FIG. 1) are coupled to the ends of the third and fourth cables 188, 194.

As best shown in FIG. 6, a plurality stops 106 are coupled to the cables 172, 188, 194 proximate the exercise stations 120, 130, 105. The stops 106 are known devices that enable tension forces to be developed within one or more of the cables 172, 183, 188, 194 when a user applies a training force at one of the exercise stations 120, 130, 105. The structural and operational aspects of the stops 106 are generally known, as described, for example, in U.S. Pat. No. 6,582,346 issued to Line et al., U.S. Pat. No. 6,482,135 issued to Ish et al., and U.S. Pat. No. RE 34,572 issued to Johnson et al., which patents are incorporated herein by reference.

In operation, a user may select one of the exercise stations 120, 130, 105 and a suitable number of plates 171 to serve as a training load 174. For example, using the first exercise station 120, the user may apply a training force on one or both of the first handles 122 (e.g. by pulling downwardly on the handles 122), causing tension in the cable and pulley assembly 170 and applying a lifting force on the training load 174. Similarly, using the third exercise station 105, the user may apply a training force on the end of the second cable 172 (e.g. by pulling upwardly on a handle or bar, not shown), causing tension in the cable and pulley assembly 170 and applying a lifting force on the training load 174.

When using the second exercise station 130, the user may adjust the height h of the frame members 132 relative to the base assembly 102 as described above. The user may then apply a training force on one or both of the second handles 138, causing tension in the cable and pulley assembly 170 and applying a lifting force on the training load 174. For those embodiments having pivotable coupling assemblies 131 that allow adjustment of the angle a between the frame members 132, the user may adjust the angle a to a desired value for performing an exercise. The angle a may remain fixed during the exercise, or alternately, may vary freely during the exercise, allowing the user considerable freedom to perform functional training movements during the exercise using the second exercise station 130.

Embodiments of apparatus and methods having adjustable frame members in accordance with the present invention may advantageously provide improved capability to enable a user to develop muscles associated with the user's every day life, such as a chosen sporting event, a hobby, or work or therapeutic activities, thereby enabling the user to perform exercises using functional training movements. More specifically, because the frame members are variably adjustable in both height h and angle a, the user may more readily perform movements intended to develop muscles associated with the user's chosen sporting event, including, for example, swinging a sporting apparatus, throwing or tossing a sporting device, or any other desired functional training movements.

Exercise Bench Assemblies Having Wheels With Integral Brakes

In accordance with further embodiments of the invention, bench assemblies for exercise machines may be equipped with integral brakes. Such exercise machine bench assemblies may automatically engage to lock or brake the wheels to prevent movement of the bench assembly when a user positions herself on the bench for use of the exercise machine, and may automatically disengage when the bench assembly is not in use user to allow the user to freely and easily move the bench assembly to another location.

FIG. 10 is a partially exploded isometric view of a bench assembly 200 in accordance with an embodiment of the invention. In this embodiment, the bench assembly 200 includes a support portion 210, a wheel assembly 220, and an exercise station 300. More specifically, the support portion 210 includes first and second pad members 212, 214 coupled to a frame assembly 216. In some embodiments, the position of the second pad member 214 is pivotably adjustable, as described, for example, in U.S. patent application Ser. No. 10/913,136 by Ish et al., which application is incorporated herein by reference. The frame assembly 216 rests on a support surface and supports the support portion 210 during use by the user.

Figure 11:
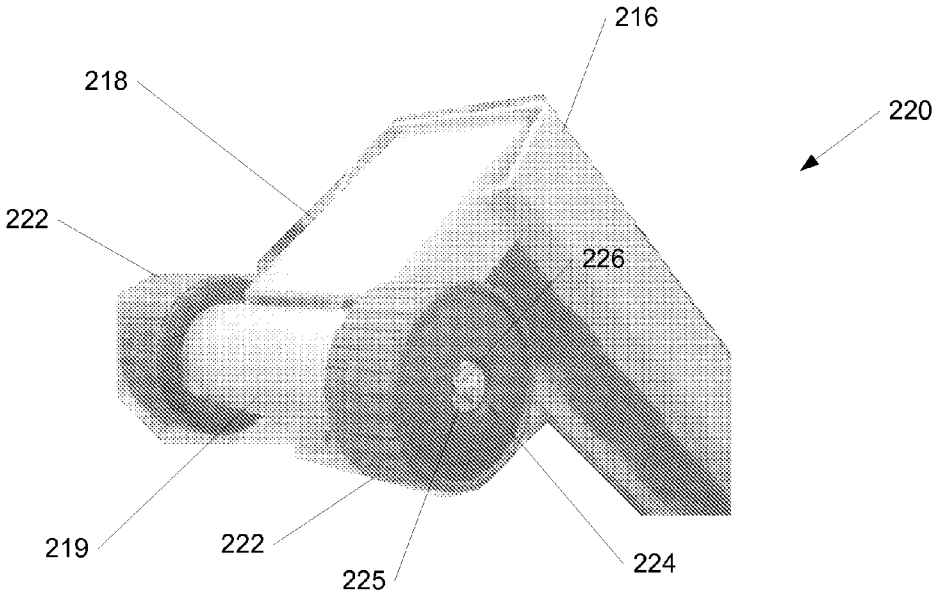
FIG. 11 is an enlarged isometric view of a wheel assembly of the bench assembly of FIG. 10.

FIG. 11 is an enlarged isometric view of the wheel assembly 220 of the bench assembly 200 of FIG. 10. In this embodiment, the wheel assembly 220 includes a main housing 218 coupled to the frame assembly 210, and an axle housing 219. Wheels 222 are coupled to opposing end portions of an axle 224 that projects through the axle housing 219. As shown in FIG. 11, the wheels 222 may be coupled to the axle 224 using, for example, washers 225 and retaining members 226.

Figure 12:
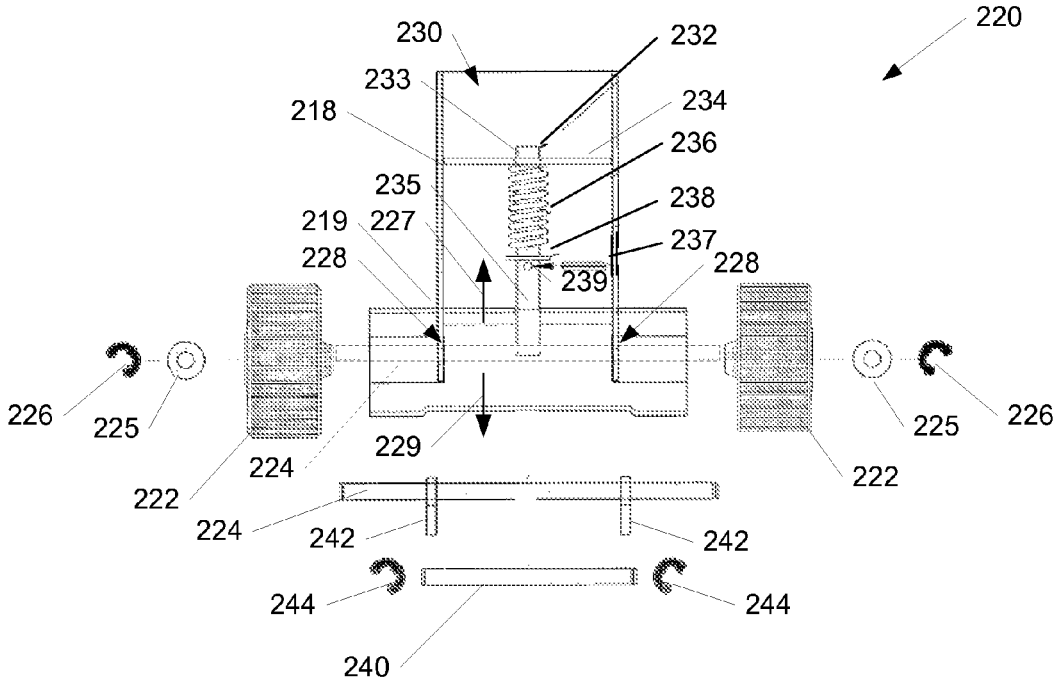
FIG. 12 is a partially-exploded cutaway view of the wheel assembly of FIG. 11.

FIG. 12 is a partially-exploded cutaway view of the wheel assembly 220 of FIG. 11. In an assembled position (shown in dashed lines in FIG. 12), the axle 224 projects through a pair of slots (or elongated apertures) 228 disposed in the main housing 218. The slots 228 enable the axle 224 to move vertically as depicted by arrows 227, 229.

The wheel assembly 220 includes a biasing mechanism 230 that engages the axle 224. In this embodiment, the biasing mechanism 230 includes a slide rod 232 that is slideably engaged through a first aperture 233 disposed in a retaining portion 234 of the main housing 218, and through a second aperture 235 disposed in the axle housing 219. A spring 236 is disposed about the slide rod 232 and is captured between the retaining portion 234 and a retaining washer 238. A retaining pin 237 is engaged through a retaining aperture 239 in the slide rod 232 and retains the retaining washer 238 on the slide rod 232. Thus, the spring 236 may be compressed between the retaining washer 238 and the retaining portion 234, thereby biasing the slide rod 232 in the downward direction 229.

As further shown in FIG. 12, a brake rod 240 is coupled to the axle 224 by a pair of downwardly depending coupling members 242. Retaining clips 244 are coupled to the ends of the brake rod 240 to secure the brake rod 240 into position on the coupling members 242.

Figure 13:
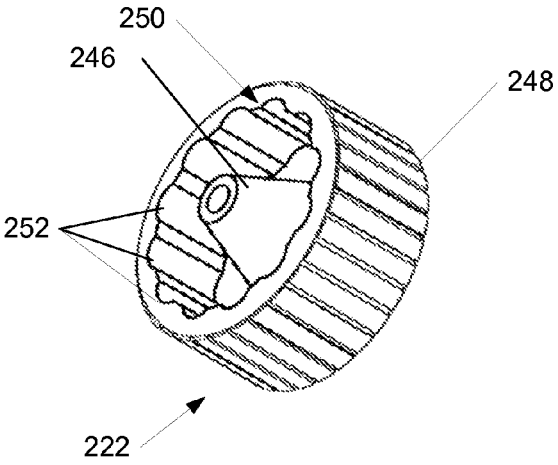
FIG. 13 is an enlarged isometric view of a wheel of the wheel assembly of FIG. 11.
Figure 14:
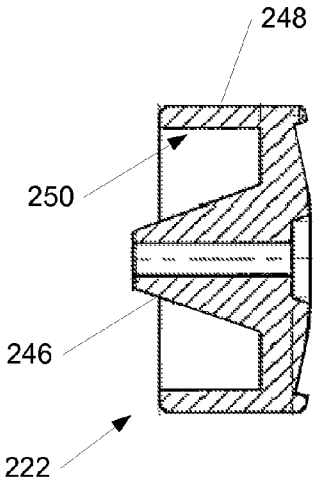
FIGS. 14 and 15 are cross-sectional and elevational views, respectively, of the wheel of FIG. 13.
Figure 15:
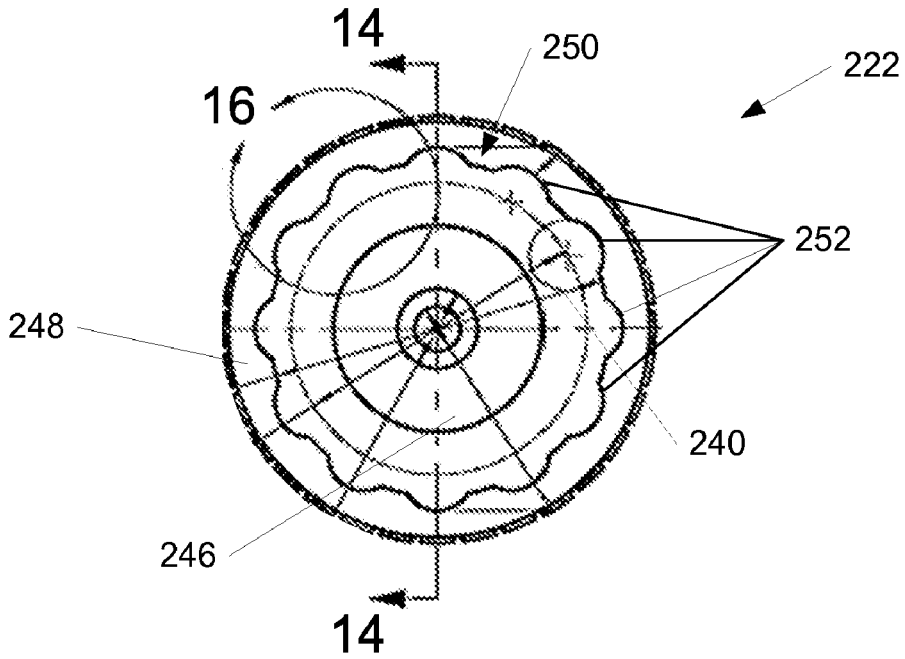
Figure 16:
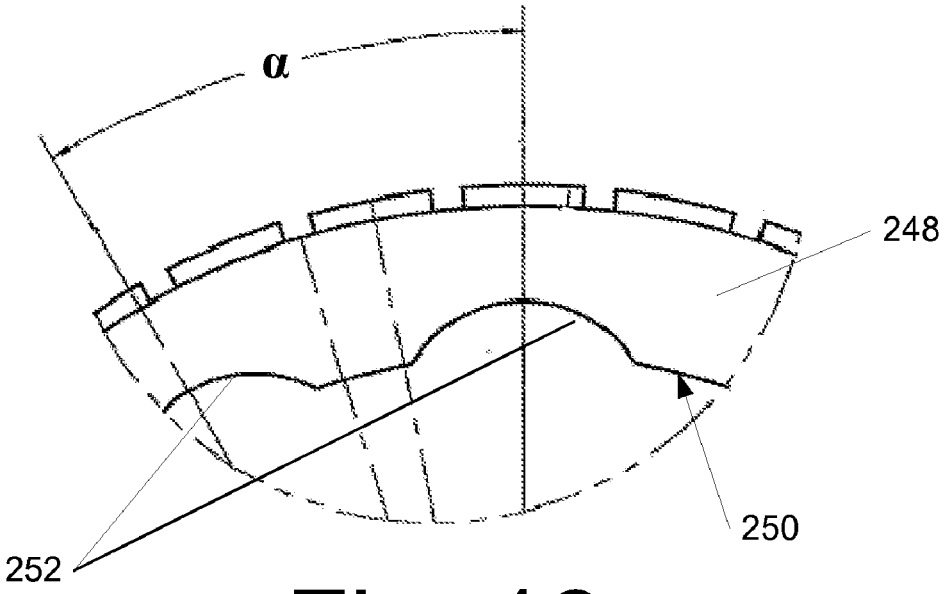
FIG. 16 is an enlarged partial view of an axle engagement portion of the wheel of FIG. 13.

FIG. 13 is an enlarged isometric view of one of the wheels 222 of the wheel assembly 220 of FIG. 11. FIGS. 14 and 15 are cross-sectional and elevational views, respectively, of the wheel 222 of FIG. 13. In this embodiment, the wheel 222 includes a hub portion 246 that couples to the axle 224, and a roller portion 248 that engages the support surface (e.g. floor) upon which the bench assembly 200 is placed. The roller portion 248 includes an inner peripheral surface 250 having a plurality of detent features 252 disposed therein. As best shown in FIG. 16, in this embodiment, the detent features 252 comprise partially-circular indentations that are distributed about the inner peripheral surface 250 and peripherally spaced apart by a spacing angle a. In one particular embodiment, the spacing angle a is approximately 30 degrees. As best shown in FIG. 15, the detent features 252 are configured to receive and engage with at least a portion of the brake rod 240.

In an initial position, when the user is not yet positioned on the bench assembly 200, the biasing mechanism 230 biases the axle 224 and the wheels 222 in the downward direction 229 within the slots 228. In this position, the brake rod 240 is not engaged with the detent features 252 of the wheels 222, and therefore, the wheels 222 and axle 224 are free to rotate, allowing the wheels 222 to roll on the support surface. Thus, the user may lift a non-wheeled end portion 254 of the bench assembly 200 (FIG. 10), and roll the bench assembly 200 on the wheel assembly 220 into a desired position on the support surface.

With the bench assembly 200 in the desired position, the user may position themselves onto the bench assembly 200. The weight of the user compresses the spring 236 of the biasing mechanism 230 and causes the axle 224 to slide in the upward direction 227 within the slots 228. As the biasing mechanism 230 is compressed, the brake rod 240 engages into one of the detent features 252 of the wheels 222, thereby locking the wheels 222 into a fixed, non-rotating position. The bench assembly 200 then remains in a non-rolling, fixed position on the support surface as the user performs an exercise using, for example, the second exercise station 130. After the user has performed the exercise and gets off of the bench assembly 200, the spring 236 of the biasing mechanism 230 automatically re-expands, biasing the axle 224 and wheels 222 in the downward direction 229, disengaging the brake rod 240 from the detent features 252 and allowing the wheels 222 to roll freely on the support surface.

It will be appreciated that a variety of alternate embodiments of biasing mechanisms 230 may be conceived, and that the invention is not limited to the particular embodiment described above and shown in the accompanying figures. For example, in alternate embodiments, the spring 236 may be replaced or augmented with other forms of biasing devices, including leaf springs, hydraulic or pneumatic cylinders, compressible resilient biasing materials, or any other suitable biasing devices. Similarly, the slide rod 232 may be replaced or augmented with additional rods or members that engage the axle to provide the desired downward biasing of the wheels 222. Furthermore, in alternate embodiments, different shapes, sizes, and spacings of the detent features 252 may be employed.

Embodiments of bench assemblies in accordance with the present disclosure may provide significant advantages over the prior art. For example, because the integral braking features of the wheel assembly automatically engages and disengages as the user gets on and off the bench assembly, the bench assembly provides the desired braking of the wheels in a highly convenient manner. The user is not required to stoop to actuate any manual brake mechanism, and instances wherein the user forgets to apply a manual brake mechanism before beginning an exercise are eliminated. Therefore, embodiments of bench assemblies in accordance with the invention may improve the user's satisfaction with the exercise experience.

Exercise Assemblies Having Foot-Retaining Apparatus

In accordance with still other embodiments of the invention, exercise assemblies may include apparatus for retaining the feet of a user during the performance of an exercise. Such exercise assemblies may advantageously provide improved control to a user during the performance of an exercise, particularly during those exercises that tend to lift the user upwardly during the performance of the exercise. Thus, embodiments of the invention may improve the user's exercise experience.

Figure 17:
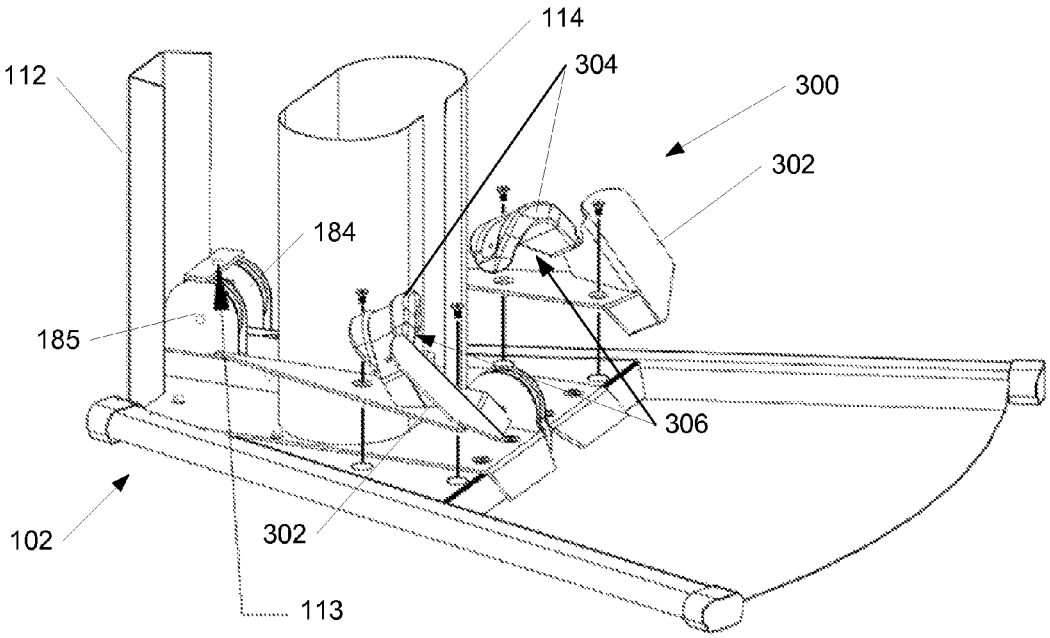
FIG. 17 is an enlarged view of a lower portion of the functional training exercise assembly showing a partially-exploded foot-retaining assembly in accordance with one embodiment of the invention.
Figure 18:
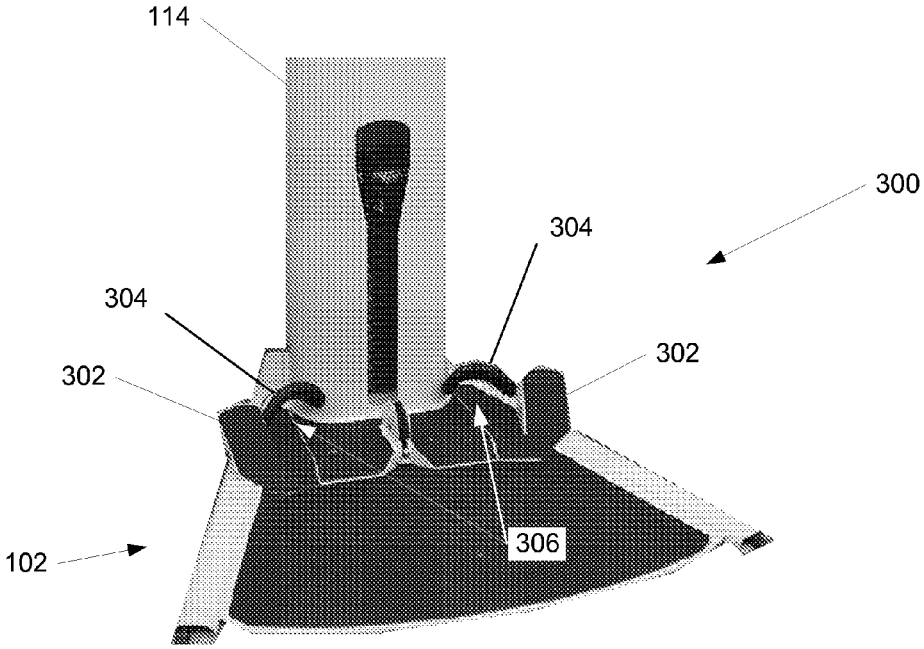
FIG. 18 is an isometric view of the foot-retaining assembly of FIG. 17 in an assembled position.

FIG. 17 is an enlarged view of a lower portion of the functional training exercise assembly 100 showing a partially-exploded foot-retaining assembly 300 in accordance with one embodiment of the invention. FIG. 18 is an isometric view of the foot-retaining assembly 300 in an assembled position. The foot-retaining assembly 300 includes a pair of retaining braces 302 that are coupled to the base assembly 102 that rests on a support surface (e.g. a floor). In this embodiment, the retaining braces 302 project upwardly and outwardly from the base assembly 102. A foot pad 304 is coupled to each retaining brace 302. The foot pad 304 and the retaining brace 302 are configured to cooperatively provide a foot-retaining space 306 adapted to receive a portion of a user's foot.

Figure 19:
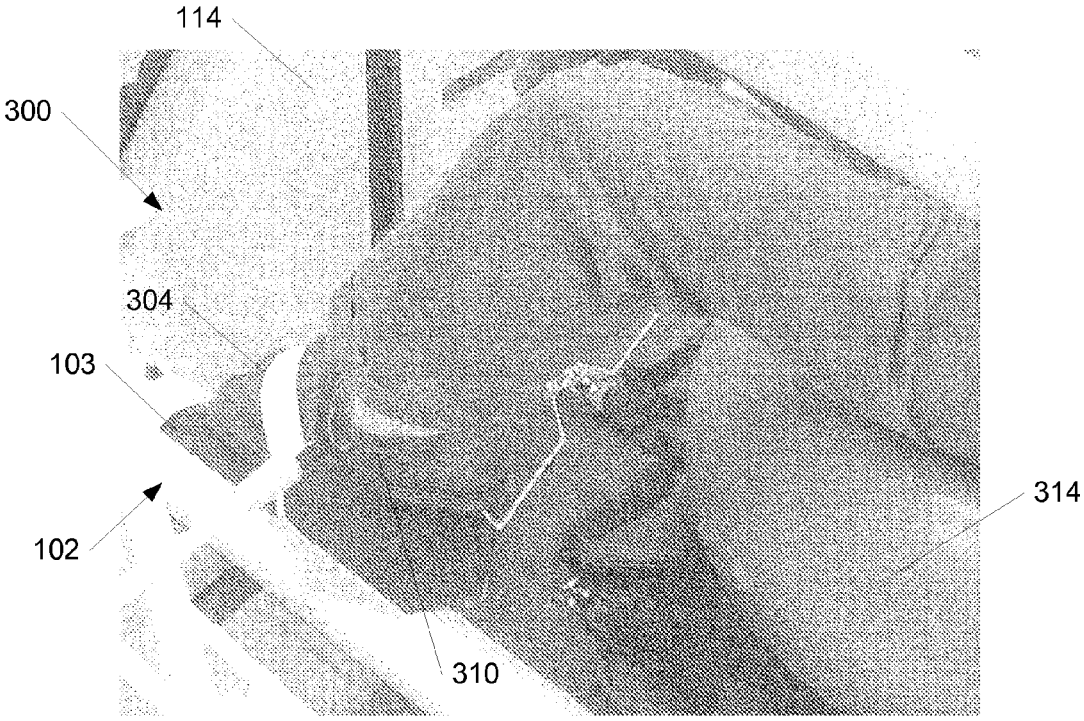
FIG. 19 is an isometric view of a user's foot engaged with the foot-retaining assembly of FIG. 18.

FIG. 19 is an isometric view of a user's foot 310 engaged with the foot-retaining assembly 300 of FIG. 18. With the user's foot 310 placed on a base plate 103 of the base assembly 102, and engaged into the foot-retaining space 306 (FIG. 18), the foot pad 304 is engaged over a portion of the user's foot 310. Thus, the foot-retaining assembly 300 reduces or prevents vertical movement (and to some extent forward and side movements) of the user's foot 310 during the performance of an exercise.

Figure 20:
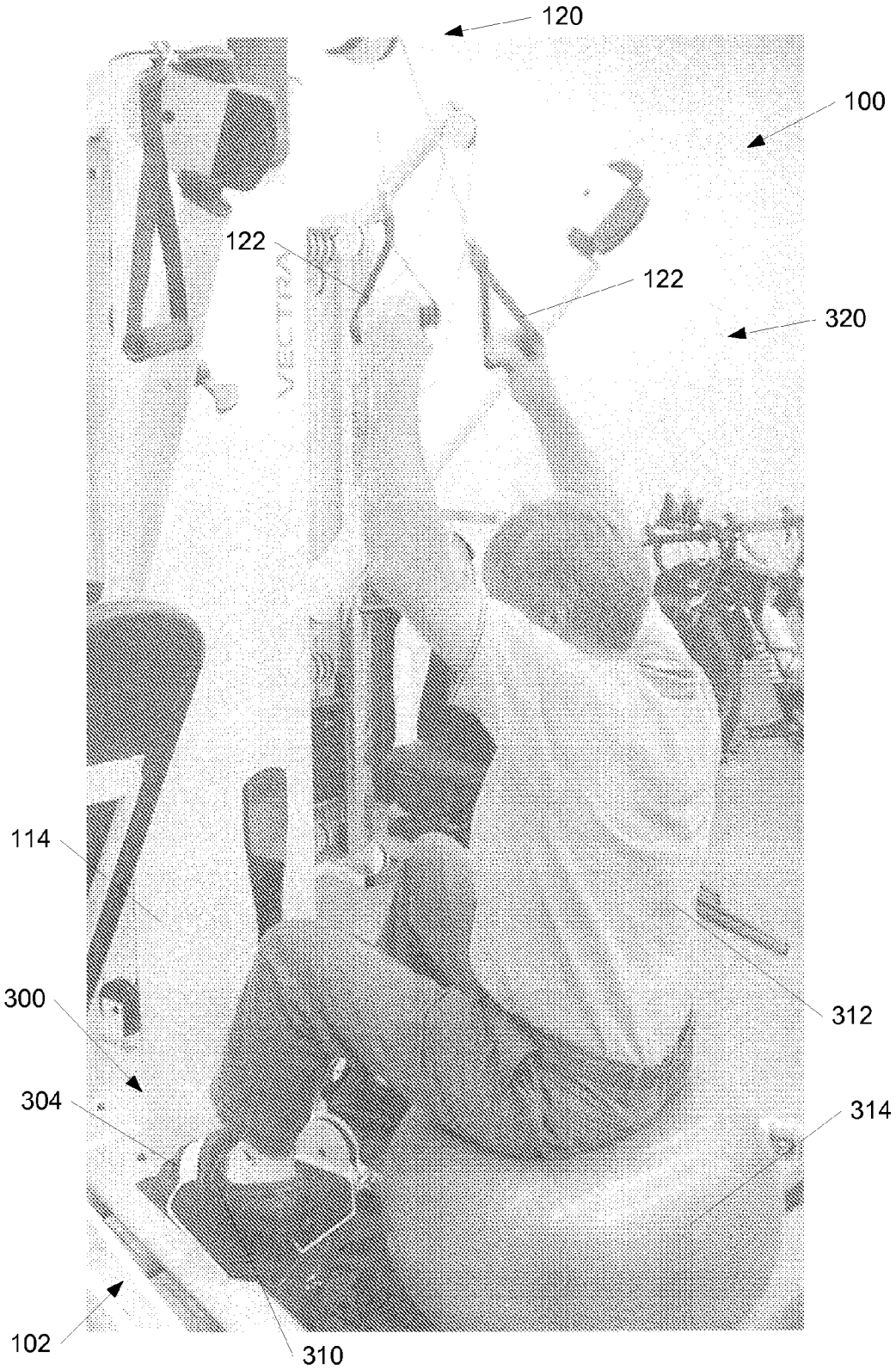
FIG. 20 is an isometric view of a user engaged with the foot-retaining assembly during a first portion of an exercise.
Figure 21:
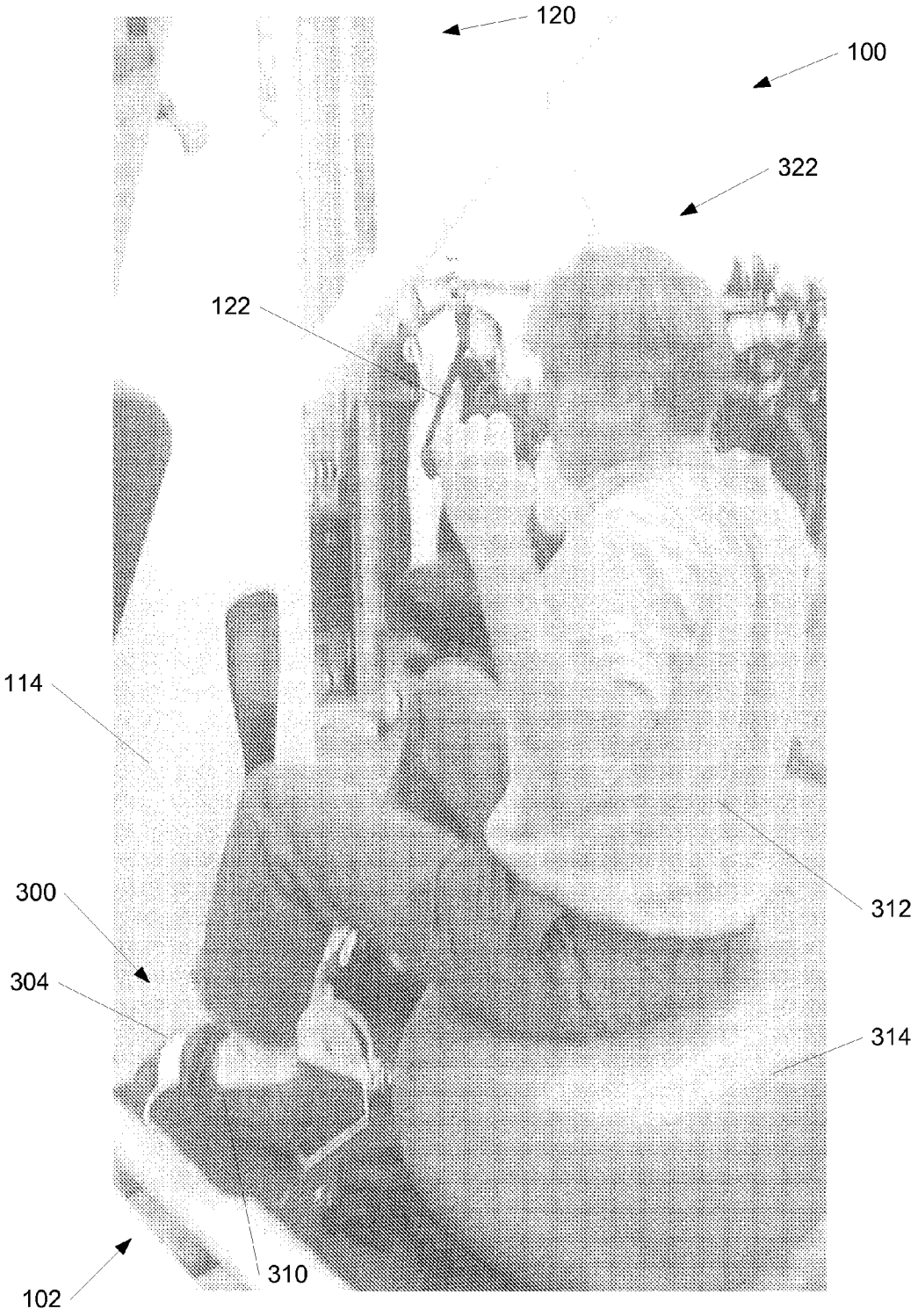
FIG. 21 is an isometric view of the user engaged with the foot-retaining assembly during a second portion of the exercise.

For example, FIG. 20 is an isometric view of a user 312 during a first portion 320 of an exercise. The user 312 is seated on an inflatable device 314 and has grasped the handles 122 of the first exercise station 120. The user's feet 310 (one visible) are engaged into the foot-retaining spaces 306 of the foot-retaining assembly 300. FIG. 21 is an isometric view of the user 312 during a second portion 322 of the exercise. As the user 312 pulls downwardly on the handles 122 from the first portion 320 to the second portion 322 of the exercise, the user's body may tend to rise upwardly (depending upon the amount of weight selected on the weight stack 174) from the inflatable device 314. With the user's feet 310 retained by the foot-retaining assembly 300, the vertical movement of the user's feet 310 is reduced or eliminated. The user 312 may then use the foot-retaining assembly 300 to prevent vertical movement of his body during the exercise, such as by flexing or exerting other muscles (e.g. leg and abdominal muscles) during the exercise.

It will be appreciated that a variety of alternate embodiments of foot-retaining assemblies 300 may be conceived, and that the invention is not limited to the particular embodiment described above and shown in the accompanying figures. For example, in alternate embodiments, the retaining braces 302 and foot pads 304 may have a variety of shapes and configurations that sufficiently provide the desired foot-retaining spaces 306 for the user's feet 310. The retaining braces 302 may, in alternate embodiments, be positioned along the outer lateral portions of the user's feet. Alternately, the braces and pads 302, 304 may be integrally formed into a single foot-retaining unit. In still further embodiments, the foot pads 304 may be eliminated, and the user's feet may be engaged directly with the retaining braces 302 or other suitable retaining members to maintain the desired position of the user's feet proximate the base assembly 102.

Exercise Assemblies Having Self-Adjusting Pad Devices

Embodiments of exercise methods and apparatus having foot-retaining assemblies may provide significant advantages over the prior art. For example, because the foot-retaining assembly reduces or eliminates vertical movement of the user's foot, the user may prevent vertical movement of his body during exercises. The user may thereby receive an improved workout, and a more satisfying exercise experience.

Figure 22:
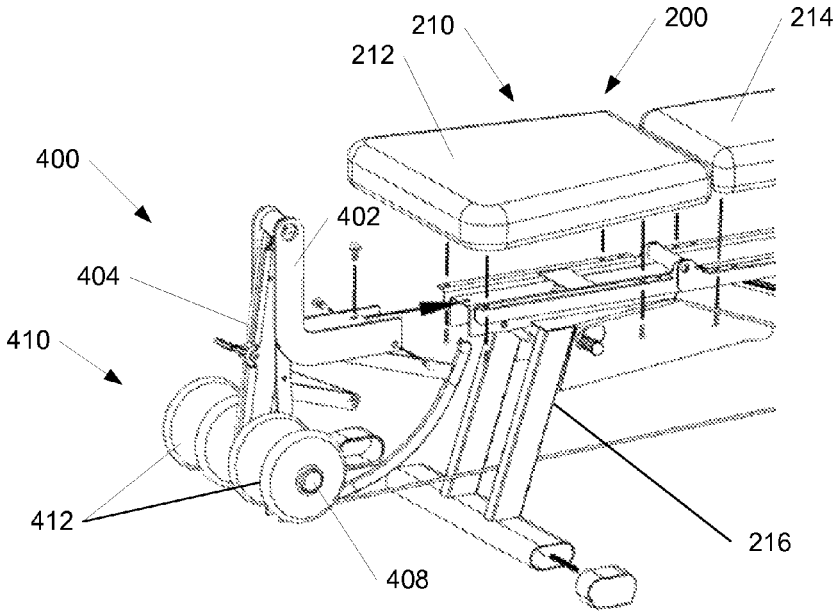
FIG. 22 is an enlarged, partially-exploded isometric view of an exercise station having a self-adjusting pad assembly in accordance with yet another embodiment of the invention.

FIG. 22 is an enlarged, partially-exploded isometric view of an exercise station 400 having a self-adjusting pad assembly 410 in accordance with yet another embodiment of the invention. Although the exercise station 400 in FIG. 22 is coupled to the bench assembly 200, in alternate embodiments, the exercise station 400 may be located at any suitable location on or proximate to the exercise assembly 100.

Figure 23:
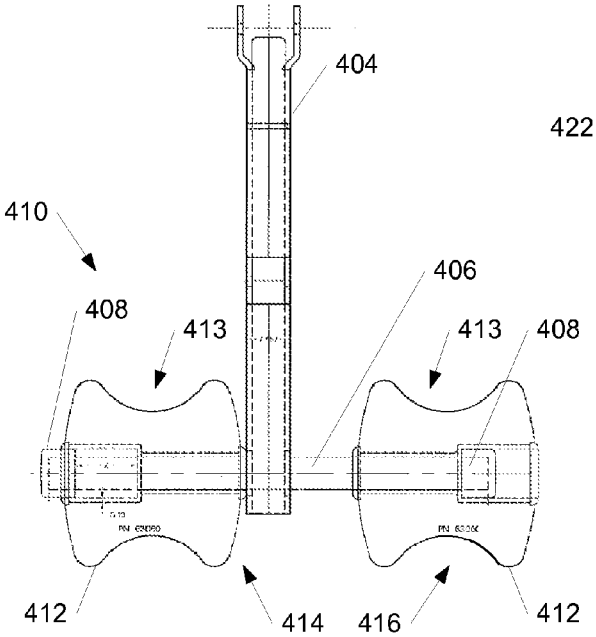
FIG. 23 is an elevational, partially-hidden view of the self-adjusting pad assembly of the exercise station of FIG. 22.

FIG. 23 is an elevational, partially-hidden view of the self-adjusting pad assembly 410 of the exercise station 400 of FIG. 22. In this embodiment, the exercise station 400 includes a main support 402 coupled to the bench assembly 200, and a swing arm 404 rotatably coupled to the main support 402. A cross support 406 is coupled to the swing arm 404 such that opposing lateral ends of the cross support 406 project outwardly from the swing arm 404.

The pad assembly 410 includes a pair of pad members 412 slideably positioned on the opposing lateral ends of the cross support 406. Each pad member 412 includes a contoured portion 413 that is configured to receive and engage with a portion of a user's body during an exercise. As best shown in FIG. 23, each pad member 412 is adjustably positionable between an inner position 414 wherein the pad member 412 is proximate the swing arm 404, and an outer position 416 wherein the pad member 412 is spaced apart from the swing arm 404. In this embodiment, a retaining cap 408 is attached to each end of the cross support 406 to prevent each corresponding pad member 412 from sliding off the cross support 406.

Figure 24:
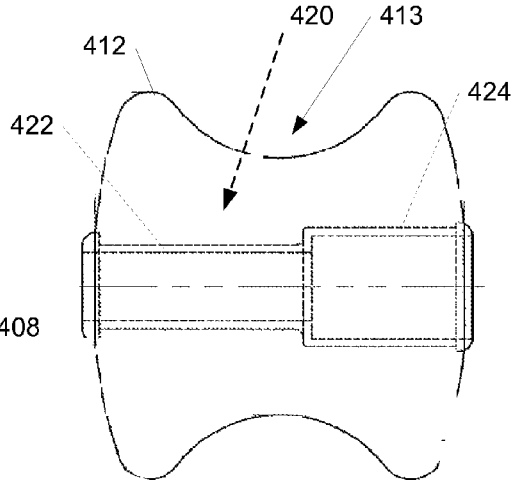
FIG. 24 is an enlarged elevational, partially-hidden view of a pad member of the self-adjusting pad assembly of FIG. 23.

FIG. 24 is an enlarged elevational, partially-hidden view of one of the pad members 412 of the self-adjusting pad assembly 410 of FIG. 23. The pad member 412 has an attachment opening 420 disposed therethrough. The attachment opening 420 includes a first (relatively-narrower) portion 422 that is sized and configured to slideably receive the cross member 406, and a second (relatively-larger) portion 424 that is sized and configured to slideably receive the retaining cap 408.

Figure 25:
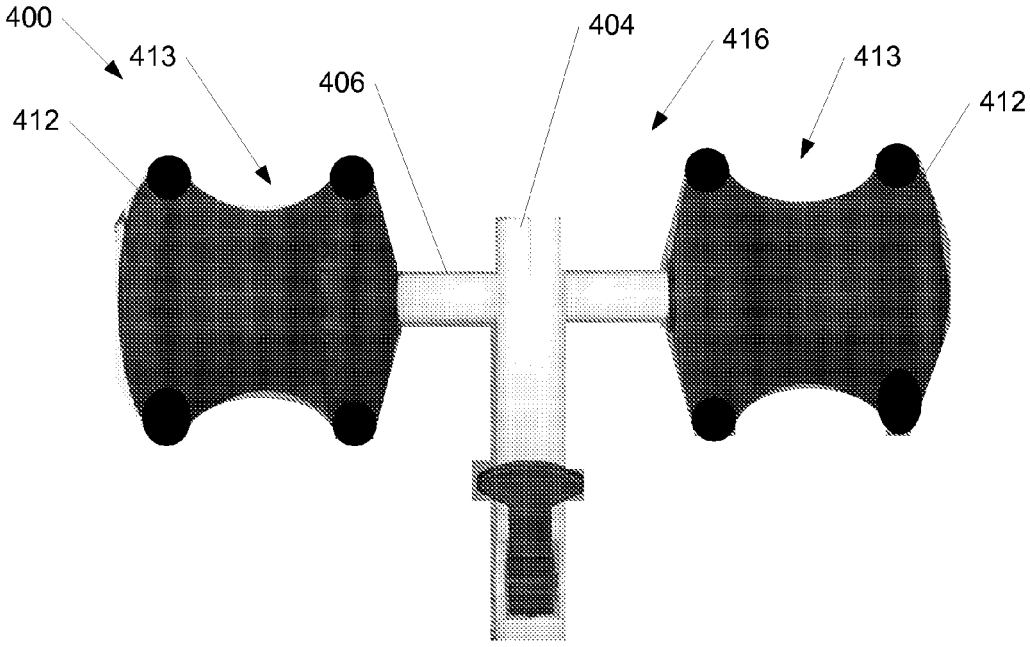
FIG. 25 is an elevational view of the self-adjusting pad assembly of FIG. 23 is a first position.
Figure 26:
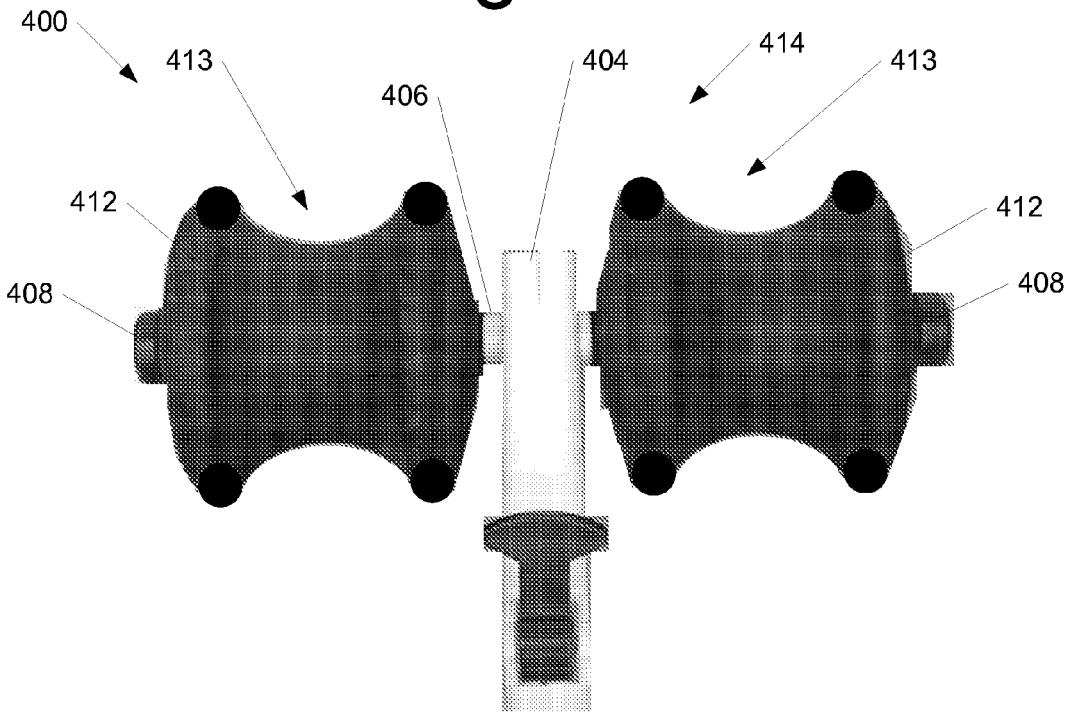
FIG. 26 is an elevational view of the self-adjusting pad assembly of FIG. 23 in a second position.

FIGS. 25 and 26 are elevational views of the pad members 412 in the outer and inner positions 416, 414, respectively. In operation, a user may be seated on the bench assembly 200 and may engage a portion of each leg (e.g. a front portion of the shin) into the contoured portions 413 of the pad members 412. As the user prepares to perform an exercise using the exercise station 400, the pad members 412 slide freely along the cross member 406 to more closely match the particular spacing of the user's legs. Because the pad members 412 may slide freely between the inner and outer positions 414, 416, the pad members 412 may self-adjust to a comfortable spacing for the user with little or no effort by the user. As the pad members 412 slide outwardly toward the outer position 416, the retaining caps 408 may become engaged into the second portions 424 of the attachment opening 420 until, in the outer position 416, the retaining caps 408 abut and end of the second portion 424 and are unable to slide into the first portion 422 of the attachment opening 420.

Figure 27:
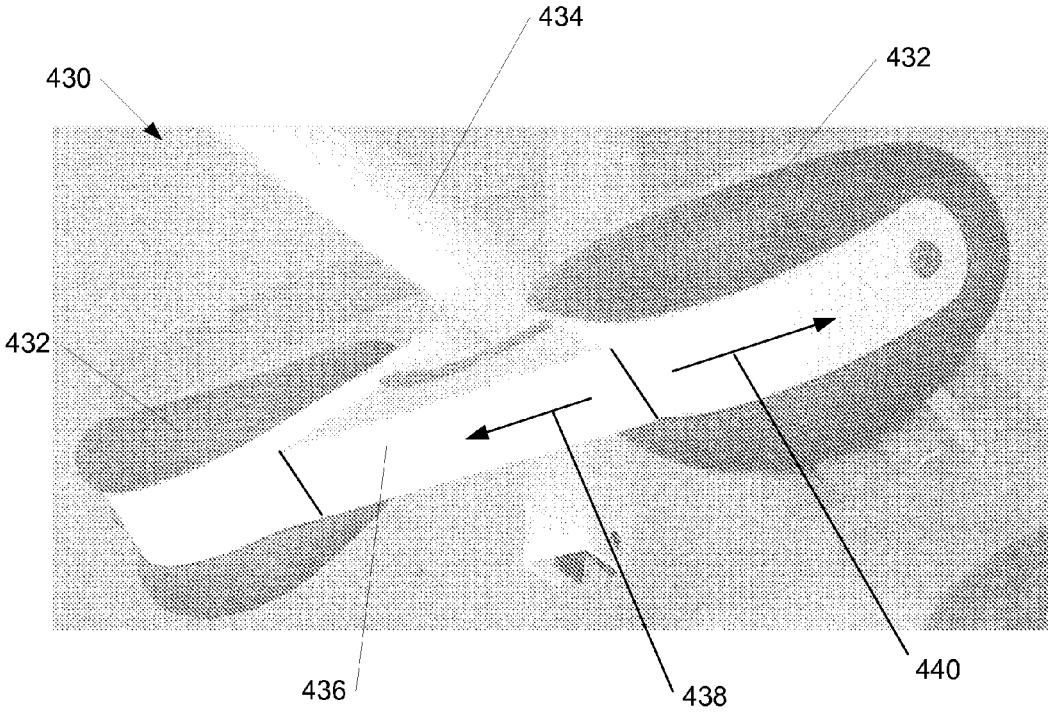
FIG. 27 is an isometric view of a self-adusting pad assembly in accordance with an alternate embodiment of the invention.

Of course, the invention is not limited to the particular embodiment described above, and a variety of alternate embodiments of self-adjusting pad devices may be conceived. For example, in alternate embodiments, a variety of different exercise stations may be equipped with self-adjusting pad assemblies in accordance with the present disclosure, including exercise stations that are configured for exercising a user's arms, abdominals, or any other suitable portion of the user's body. Also, the pad members may have a variety of suitable shapes. In one particular embodiment, as shown in FIG. 27, a pad assembly 430 in accordance with the present invention may include a pair of contoured, non-axisymmetric pad members 432. Although not visible in FIG. 27, each non-axisymmetric pad member 432 may include an attachment opening 420 having first and second portions 422, 424 as shown in FIGS. 22 and 23, and may be slideably coupled to a rectangularly-shaped cross support 436 (having correspondingly rectangularly-shaped retaining portions similar to retaining caps 408 shown in FIG. 23) attached to a swing arm 434. The pad members 432 may thereby slideably move along the cross support 436 along inward and outward directions 438, 440 to provide the desired adjustability.

Embodiments of pad assemblies in accordance with the present disclosure may provide significant advantages over the prior art. Embodiments of the invention may advantageously provide improved positioning of pad devices to meet the needs of different users in a convenient, efficient, and cost-effective manner. Thus, because pad assemblies in accordance with the present invention may adjust with little or no effort from the user, the user may have a more comfortable and satisfactory exercise experience.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An exercise assembly that enables a user to perform an exercise, comprising:

a load;

a support assembly operatively positioned relative to the load and including a base assembly configured to engage a support surface, and at least one exercise station;

a force-transferring assembly operatively coupled between the load and the at least one exercise station, the force-transferring assembly being configured such that a training force applied to the at least one exercise station induces an associated force on the load; and a foot-retaining assembly operatively coupled to the support assembly and including at least one foot-retaining device defining a foot-retaining space proximate the base assembly and configured to receive at least a portion of a foot of the user, the at least one foot-retaining device being further configured to prevent a vertical movement of the foot of the user during the performance of the exercise, wherein the at least one foot-retaining device includes:

a retaining brace coupled to and projecting upwardly from the base assembly; and a foot pad coupled to the retaining brace, the foot pad being configured to engage a portion of the foot when the foot is received within the foot-retaining space.

2. An exercise assembly that enables a user to perform an exercise, comprising:

a load;

a support assembly operatively positioned relative to the load and including a base assembly configured to engage a support surface, and at least one exercise station;

a force-transferring assembly operatively coupled between the load and the at least one exercise station, the force-transferring assembly being configured such that a training force applied to the at least one exercise station induces an associated force on the load; and a foot-retaining assembly operatively coupled to the support assembly and including at least one foot-retaining device defining a foot-retaining space proximate the base assembly and configured to receive at least a portion of a foot of the user, the at least one foot-retaining device being further configured to prevent a vertical movement of the foot of the user during the performance of the exercise, wherein the at least one foot-retaining device comprises a pair of foot-retaining devices, each foot-retaining device including:

a retaining brace coupled to and projecting upwardly from the base assembly; and a foot pad coupled to the retaining brace, the foot-retaining space being at least partially defined by the foot pad, the retaining brace, and the base assembly, the foot-retaining space being positioned laterally outwardly from the retaining brace, the foot pad being configured to engage a portion of the foot when the foot is received within the foot-retaining space.

3. The exercise assembly of claim 2, wherein at least one of the retaining brace and the foot pad is further configured to project laterally outwardly over the foot-retaining space.

4. The exercise assembly of claim 1, wherein the force-transferring assembly includes a cable and pulley assembly.

5. The exercise assembly of claim 4, wherein the at least one exercise station includes a pull down station spaced apart from the base assembly and having at least one handle coupled to the cable and pulley assembly.

6. The exercise assembly of claim 4, wherein the cable and pulley assembly includes:

a first cable coupled to the load; and a second cable operatively engaged with the first cable by a double floating pulley, and wherein the at least one exercise station is operatively coupled to the second cable.

7. An exercise assembly that enables a user to perform an exercise, comprising:

a load;

a support assembly operatively positioned relative to the load and including a base assembly and at least one exercise station;

a force-transferring assembly operatively coupled between the load and the at least one exercise station, the force-transferring assembly being configured such that a training force applied to the at least one exercise station induces an associated force on the load; and a foot-retaining assembly operatively coupled to the support assembly and including a pair of foot-retaining devices, each foot-retaining device being configured to prevent a vertical movement of a foot of the user during the performance of the exercise, each foot-retaining device including:

a retaining brace coupled to and projecting upwardly from the base assembly; and a foot pad coupled to the retaining brace, wherein the foot pad, the retaining brace, and the base assembly define a foot-retaining space proximate the base assembly and configured to receive at least a portion of the foot of the user, the foot-retaining space being positioned laterally outwardly from the retaining brace, the foot pad being configured to engage a portion of the foot when the foot is received within the foot-retaining space.

8. The exercise assembly of claim 7, wherein each foot-retaining device is further configured to prevent a forward movement and an inwardly lateral movement of the foot.

9. The exercise assembly of claim 7, wherein at least one of the retaining brace and the foot pad is further configured to project laterally outwardly over the foot-retaining space.

10. The exercise assembly of claim 7, wherein the force-transferring assembly includes a cable and pulley assembly.

11. The exercise assembly of claim 10, wherein the at least one exercise station includes a pull down station spaced apart from the base assembly and having at least one handle coupled to the cable and pulley assembly.

12. A method of performing exercises, comprising:

providing a support assembly operatively positioned relative to a load, the support assembly including a base assembly configured to engage a support surface, and an exercise station;

engaging at least a portion of a user's foot into a foot-retaining assembly proximate the base assembly;

applying a training force to a force-transferring assembly operatively coupled between the load and to the exercise station, the force-transferring assembly being configured such that the training force applied to the exercise station induces an associated force on the load; and simultaneously with applying the training force, preventing a vertical movement of the user's foot using the foot-retaining assembly.

13. The method of claim 12, wherein the foot-retaining assembly includes:

a retaining brace coupled to and projecting upwardly from the base assembly; and a foot pad coupled to the retaining brace, the retaining brace and the foot pad being configured to define a foot-retaining space, and wherein engaging at least a portion of a user's foot into a foot-retaining assembly includes engaging at least a portion of a user's foot into the foot-retaining space.

14. The method of claim 12, wherein the foot-retaining assembly includes a pair of foot-retaining devices, each foot-retaining device having:

a retaining brace coupled to and projecting upwardly from the base assembly; and a foot pad coupled to the retaining brace, wherein the foot pad, the retaining brace, and the base assembly are configured to define a foot-retaining space, the foot-retaining space being positioned laterally outwardly from the retaining brace, the foot pad being configured to engage a portion of the foot when the foot is received within the foot-retaining space, and wherein engaging at least a portion of a user's foot into a foot-retaining assembly includes engaging at least a portion of each foot into a corresponding one of the foot-retaining spaces.

15. The method of claim 12, wherein applying a training force to a force-transferring assembly includes applying a training force to a cable and pulley assembly.

16. The method of claim 12, further comprising, simultaneously with applying the training force, preventing a vertical movement of a body of the user.

17. The method of claim 16, wherein preventing a vertical movement of a body of the user includes flexing at least one of a leg muscle and an abdominal muscle of the body.

* * * * *